US005681392A

United States Patent [19]

Swain

[11] Patent Number: 5,681,392

[45] Date of Patent: Oct. 28, 1997

[54] FLUID RESERVOIR CONTAINING PANELS FOR REDUCING RATE OF FLUID FLOW

[75] Inventor: Eugene A. Swain, Webster, N.Y.

[73] Assignee: Xerox Corporation, Stamford, Conn.

[21] Appl. No.: 576,141

[22] Filed: Dec. 21, 1995

[51] Int. Cl.[6] ..... B05C 3/02

[52] U.S. Cl. ..... 118/407; 118/400; 118/401; 118/429; 427/430.1

[58] Field of Search ..... 118/400, 401, 118/429, 407; 427/430.1

[56] References Cited

U.S. PATENT DOCUMENTS

| | | | |
|---|---|---|---|
| 3,178,308 | 4/1965 | Oxley et al. | 118/429 |
| 3,673,982 | 7/1972 | Rutledge et al. | 118/429 |
| 4,004,056 | 1/1977 | Carroll | 428/138 |
| 4,204,498 | 5/1980 | Ivancic | 427/430.1 |
| 4,204,929 | 5/1980 | Bier | 204/180 R |
| 4,455,326 | 6/1984 | Garner | 118/429 |
| 4,693,307 | 9/1987 | Scarselletta | 165/152 |
| 4,964,366 | 10/1990 | Kurokawa et al. | 118/429 |
| 5,298,292 | 3/1994 | Dilko et al. | 427/543 |

FOREIGN PATENT DOCUMENTS

| | | |
|---|---|---|
| 2-146549 | 6/1990 | Japan . |
| 8-62868 | 3/1996 | Japan . |

*Primary Examiner*—Donald E. Czaja
*Assistant Examiner*—Michael P. Colaianni

[57] ABSTRACT

A reservoir for dipping a non-cylindrical flexible belt into a coating fluid so that an electrophotographic layer can be deposited onto its outer surface during a manufacturing process includes a non-cylindrical tank with an inlet located at one end. A coating fluid enters the bottom of the tank and moves past a flow divider located inside or just above the inlet. This divides the entering fluid into two substantially equal portions, so that the level of coating fluid inside of the tank rises uniformly. The coating fluid passes first through a porous membrane, and then through a perforated plate, both of which will reduce the velocity of the coating fluid, to ensure that the fluid has laminar flow characteristics once it reaches the top of the reservoir. Finally, the coating fluid passes through an annular shaped flow director which ensures that the layer which is deposited onto the outer surface of the flexible belt has a uniform thickness. This enables the finished belt to be used as an organic photoreceptor in an xerographic imaging machine.

16 Claims, 5 Drawing Sheets

FLUID RESERVOIR CONTAINING PANELS FOR REDUCING RATE OF FLUID FLOW

This invention relates generally to a method and apparatus for processing a flexible belt for use in a xerographic imaging machine. More specifically, the invention discloses a fluid reservoir into which a non-cylindrical flexible belt can be placed in order to deposit one or more photosensitive solutions onto its surface. Coating the belt with these photosensitive substances will transform it into an organic photoreceptor which is a central part in the imaging machine.

BACKGROUND OF THE INVENTION

The xerographic imaging process begins by exposing a light image of an original document to an organic photoreceptor (hereinafter OPC) that contains a uniform electrical charge. Exposing the charged OPC to a light image discharges the photoconductive surface in areas corresponding to non-image areas in the original document while maintaining the charge in image areas. This selective discharging scheme results in the creation of an electrostatic latent image of the original document on the OPC. The latent image is transformed into a visible image by depositing a developer material onto the surface of the OPC, then transferring the developer material from the OPC to the copy sheet, and permanently affixing it to the sheet. This provides a "hard copy" reproduction of the original document or image. The OPC is then cleaned to remove any charge and/or residual developing material from its surface to prepare it for subsequent imaging cycles.

Typical OPCs are made from rigid cylindrical drums. The materials used to make these drums include, but are not limited to, nickel, stainless steel, aluminum, brass, polymerics, and paper. In order to transform an untreated drum into an OPC, the drum must be dipped and coated with at least one solution which will cause its outer surface to become photosensitive. The dipping and coating process generally includes immersing the drum in a photosensitive fluid, allowing it to soak, and then slowly withdrawing the drum from the fluid to retain the desired coating thickness.

While a rigid cylindrical drum is one type of member that is suitable for manufacture of imaging members, OPCs made from rigid drums are not desirable for use in all xerographic copying machines. Because only a limited portion of the original image can be exposed onto a rigid drum at any particular instant in time, extended periods of time may be required to obtain enough light to reproduce the entire original document as an electrostatic latent image on the surface of such an OPC. This means that using an OPC that has been made from a rigid cylinder limits the speed at which the original document can be reproduced. Thus, OPCs made from rigid cylinders are not suitable for use in high speed xerographic printing and copying machines. On the other hand, an OPC that has been manufactured from a flexible belt can be configured within the photocopying machine such that the entire original image can be exposed at one time. Therefore, use of an OPC made from a flexible belt allows the speed at which the original image can be reproduced to be dramatically increased.

Controlling the costs of manufacturing these flexible belts is a primary concern. One way of controlling such costs is to dip many flexible belts at a single time. The present invention is generally used in a manufacturing scheme which requires each flexible belt to be dipped in a separate tank. In this type of scheme, the number of tanks that can be used at one time, and therefore, the number of belts that can be dipped is limited by the size of the area in which the tanks are located. Present methods of dipping flexible belts use a circular tank. More tanks can be placed into a single area if they have been formed into an oval, rather than circular shape.

Unfortunately a circular tank cannot simply be replaced with an oval shaped tank in a typical dipping scheme. The photosensitive coating fluid that is used during dipping is fed into the coating tank from an inlet located at the bottom of the tank. When fluid is fed into the bottom of an oval shaped tank, eddies form at the edge of the inlet, making it difficult to maintain uniform flow once the fluid reaches the annulus between the tank wall and the belt. If the fluid flow in this area is not uniform, the photosensitive coating that is deposited onto the surface of the belt will be uneven. This means that the finished OPC will not perform properly in the imaging machine.

There is a need, which the present invention addresses, for new apparatus which will allow the flow of fluid to remain uniform in the annular space between a flexible belt and the wall of an oval shaped dipping tank when the fluid is fed into the tank from its bottom. An apparatus such as this will make it much easier to transform flexible belts which have been formed into an oval shape into uniformly coated OPCs.

The following disclosures may be relevant to various aspects of the present invention:

U.S. Pat. No. 5,298,292 discloses a method for applying a coating solution onto a substrate, and is a typical example of the type of system in which the present invention may be used. The method includes a device for dipping and removing the substrate into and from the solution. It also includes a heating device for inductively heating the substrate while the dipping device removes the substrate from the coating solution. The method may also include a drying device for blowing hot gases onto the coated portion of the substrate.

U.S. Pat. No. 4,693,307 discloses a motor vehicle tube and fin heat exchanger comprising a plurality of tubes and fins arranged in spaced side-by-side relationship. The invention includes a "hybrid" fin arrangement which maintains an efficient means of heat transfer while minimizing the pressure drop.

U.S. Pat. No. 4,204,929 discloses a method and apparatus for isoelectric focusing of fluids, a technique used in the separation and purification of biological materials. Fluid enters the device from a single direction, and is streamlined by providing a plurality of permeable microporous membranes which define generally parallel channels oriented in the flow direction. An electrical potential is applied across the streamlined channels of flowing fluid to separate these biological materials into narrow zones, thereby achieving isoelectric focusing.

U.S. Pat. No. 4,004,056 discloses a porous laminated sheet which is typically used as a wall of a combustion liner. The sheet has a front layer with grooves leading to outlets from the front layer and has a rear layer defining channels from the exposed face of the rear layer into the grooves. The sheet is cooled by air which flows through the sheet from its rear face to its front face.

All of the references cited herein are incorporated by reference for their teachings.

SUMMARY OF THE INVENTION

The present invention is directed to an apparatus for dipping non-cylindrical, flexible belts into a solution so that a photosensitive coating with a uniform thickness may be deposited onto the surface of the belt.

In accordance with the invention, there is provided a fluid reservoir for dipping non-cylindrical members in a fluid comprising a tank; said tank defining an inlet through which the fluid may enter; a flow divider; a porous membrane; a perforated plate; and a flow director whereby movement of the fluid through the reservoir will transform the characteristics of the fluid from turbulent, unsteady and non-uniform, to laminar, steady-state, and uniform.

In accordance with one aspect of the invention, there is provided a porous membrane comprising a first flat plate defining a plurality of apertures dispersed throughout its surface; said apertures having diameters of sufficient size to cause the exiting fluid to have a Reynolds number less than or equal to 3000.

In accordance with another aspect of the invention, there is provided a perforated plate comprising a second flat plate defining a plurality of apertures dispersed throughout its surface; said apertures having diameters of sufficient size to cause the exiting fluid to have a Reynolds number less than or equal to 1000.

The present invention has significant advantages over current apparatus used to dip flexible belts. First, the invention provides a non-circular apparatus into which flexible belts may be dipped during coating. Known devices have a circular shape, which forces the belts to be formed into a circular shape for dipping. This means that fewer belts can be dipped at a single time when the available amount of space is limited.

In addition, the non-circular shape of the present invention will assist in properly distributing the coating solution throughout the reservoir. This will ensure that the coating will have a uniform thickness after it has been deposited onto the surface of the belt and dried. This will enable the finished photoreceptor to operate properly when it is placed inside the imaging machine.

BRIEF DESCRIPTION OF THE DRAWINGS

These and other aspects of the present invention will become apparent as the following description proceeds and upon reference to the Figures which represent preferred embodiments.

DETAILED DESCRIPTION OF THE PREFERRED EMBODIMENT

Figure 1A:
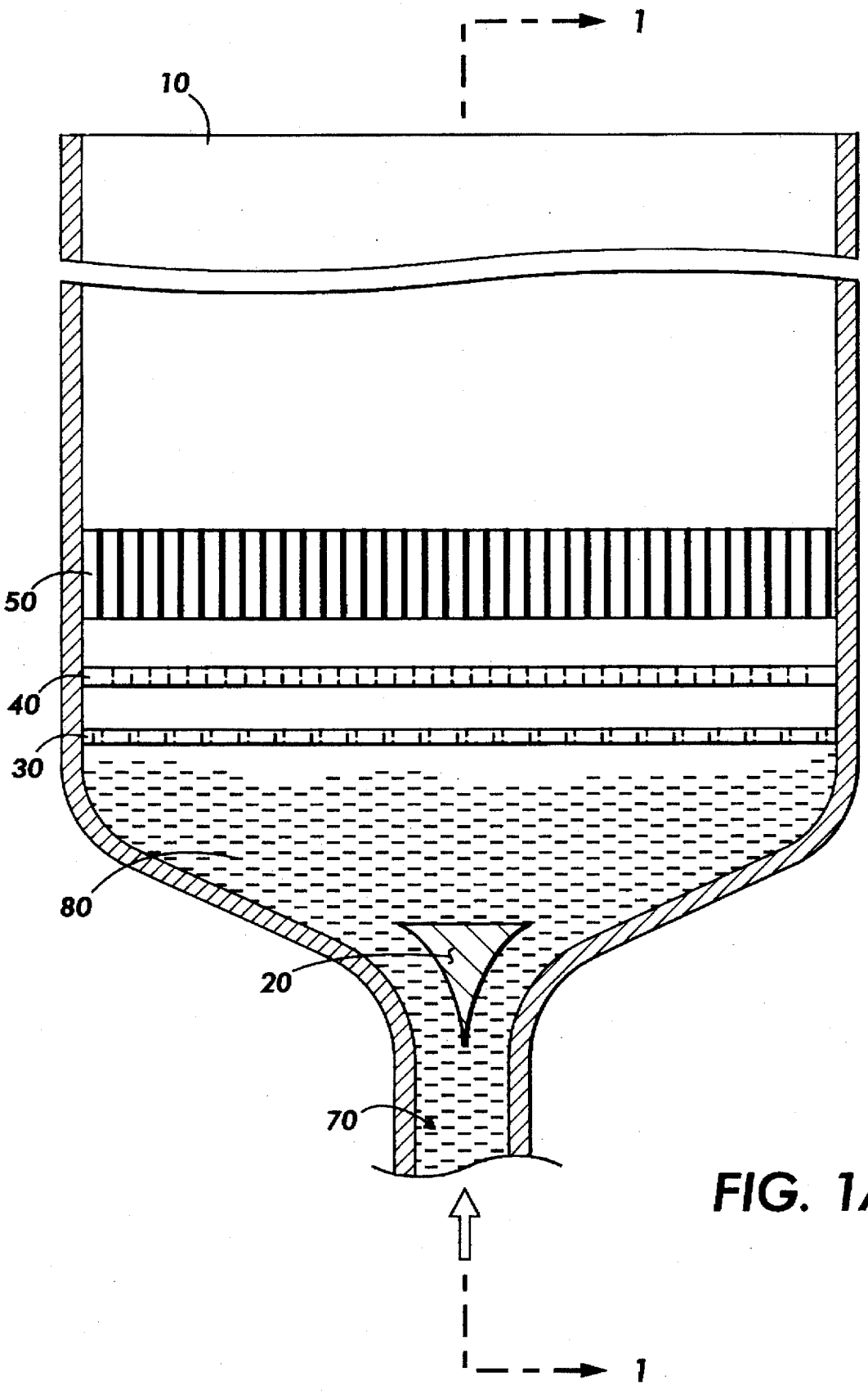
FIG. 1A depicts a section view of the assembled fluid reservoir.
Figure 1B:
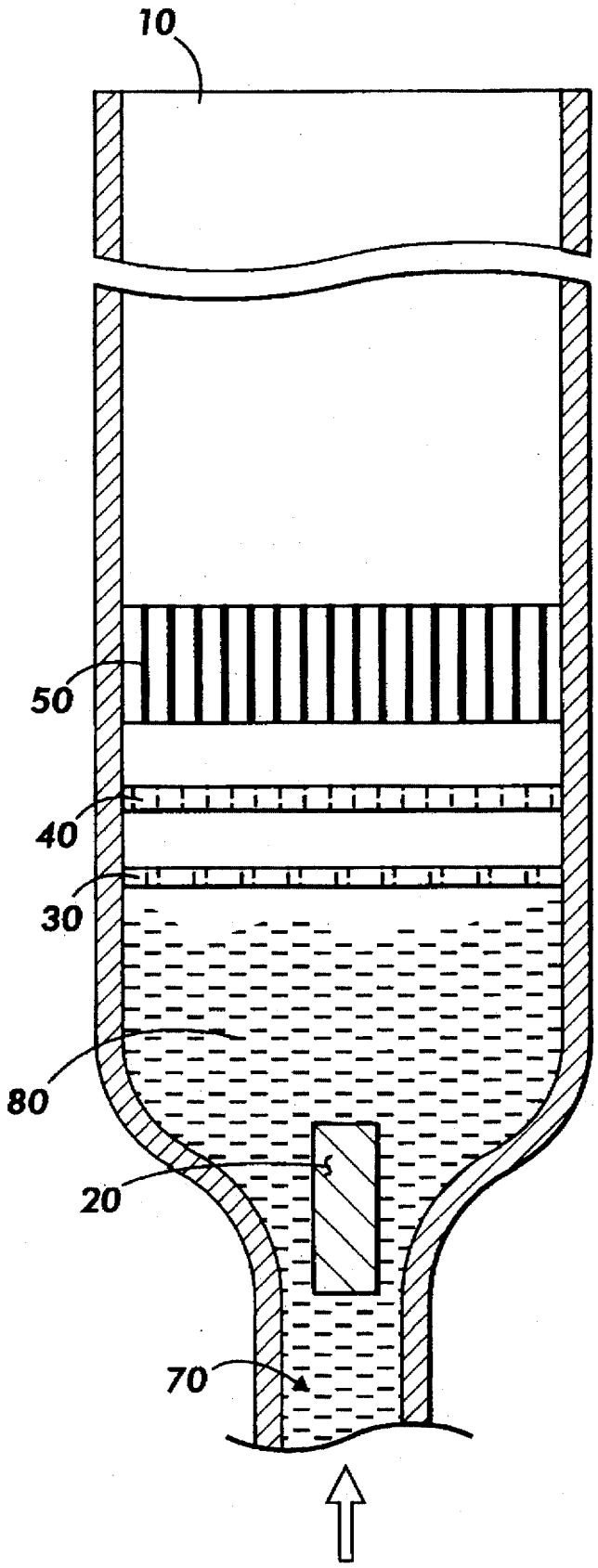
FIG. 1B depicts a side view of the assembled fluid reservoir taken along 1—1.

Referring now to the drawings where the showings are for the purpose of describing an embodiment of the invention and not for limiting same, FIG. 1 depicts a section view of oval shaped fluid reservoir 10 of the present invention. Flexible belt 60 will be placed into the top of fluid reservoir 10, and coating fluid 80 will enter through inlet 70, located at the bottom. When coating fluid 80 passes through inlet 70 it will generally exhibit turbulent, non-uniform, and unsteady characteristics.

Figure 2:
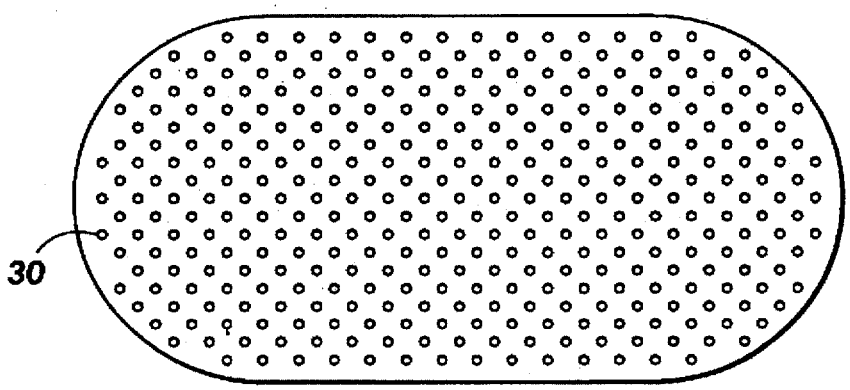
FIG. 2 depicts a top view of the porous membrane.

In accordance with one aspect of the invention, flow divider 20, located inside or just above inlet 70, will separate coating fluid 80 into two substantially equal portions as the fluid enters fluid reservoir 10. Coating fluid 80 will move past flow divider 20, and will continue to flow toward the top of fluid reservoir 10, through porous membrane 30, shown in detail in FIG. 2. As depicted in the illustration, small holes are dispersed across the surface of porous membrane 30. The size of these holes is dependent upon the characteristics of coating fluid 80, and the design of the other parts which comprise fluid reservoir 10. The design of these other parts of fluid reservoir 10 will be provided in detail below. In the described embodiment of the invention, the holes in porous membrane 30 all have the same diameter. Under some circumstances, optimal flow characteristics may require varying the diameters of these holes. The invention is intended to embrace all such design alternatives, and is not limited to the disclosed embodiments. As coating fluid 80 comes in contact with porous membrane 30, its pressure will equalize on the bottom side of the membrane where the fluid enters the holes. This means that the pressure of the fluid will equalize across the entire tank, thereby resulting in semi-laminar flow as the fluid moves through the holes in porous membrane 30.

Figure 3A:
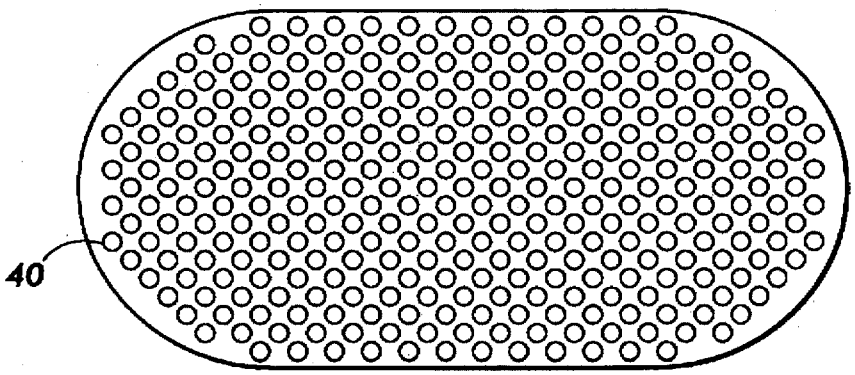
FIG. 3A depicts a top view of one embodiment of the perforated plate of the present invention, showing perforations throughout the entire surface of the plate.
Figure 3B:
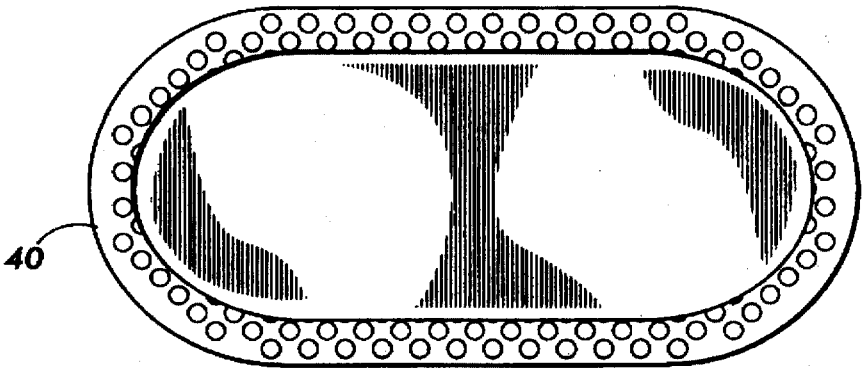
FIG. 3B depicts another embodiment of the present invention, having perforations only around the periphery of the plate.

Referring back to FIG. 1, coating fluid 80 will exit the holes in porous membrane 30, and move towards the top of fluid reservoir 10, passing next through perforated plate 40. Perforated plate 40 is shown in detail in FIG. 3. In the illustration shown, holes having the same diameter size are dispersed across its entire surface, and the holes on perforated plate 40 are generally larger than those on porous membrane 30. Again, the invention is not limited to this embodiment. It may sometimes be desirable to vary the diameter of the holes on a single perforated plate 40, or to place the holes substantially or entirely around the outer edge of the outer edge of the surface of perforated plate 40 in as shown in FIG. 3B characteristics in coating fluid 80. As shown for example in FIG. 3B. As coating fluid 80 moves through the holes in perforated plate 40, the pressure will again equalize, resulting in a smooth, slow, uniform fluid flow so that the resulting coating layer on the outer surface of flexible belt 60 will have a uniform thickness.

Figure 4:
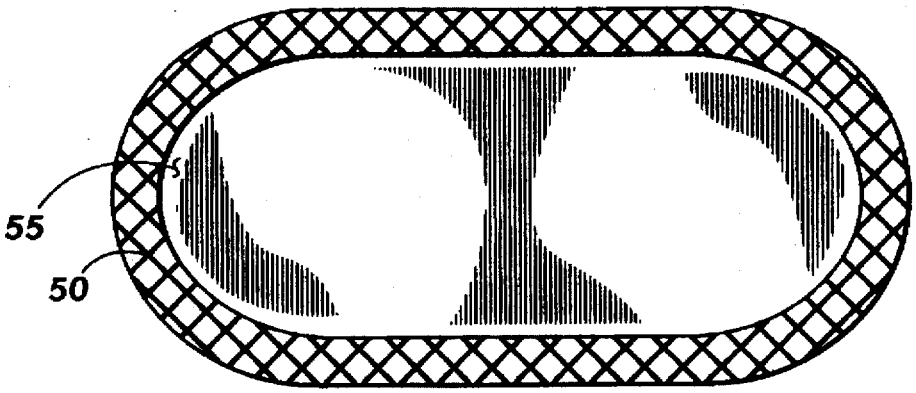
FIG. 4 depicts a top view of the flow straightener.
Figure 5:
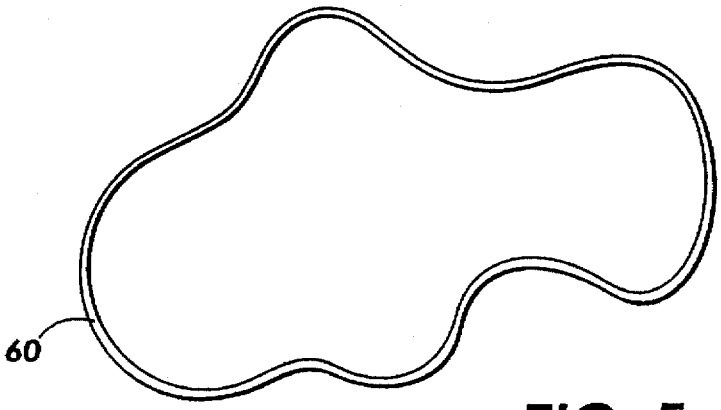
FIG. 5 depicts a plan view of a typical flexible belt for which the present invention will be used.
Figure 6:
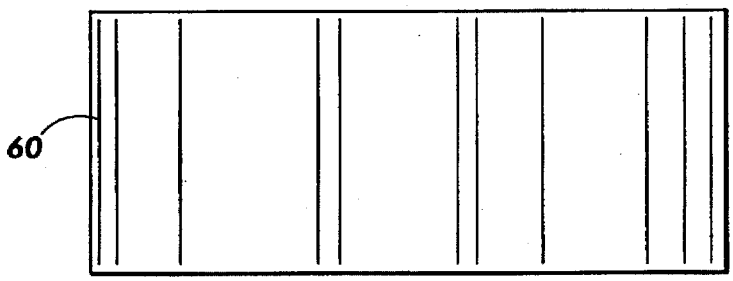
FIG. 6 depicts an elevation view of a typical flexible belt for which the present invention will be used.
Figure 7:
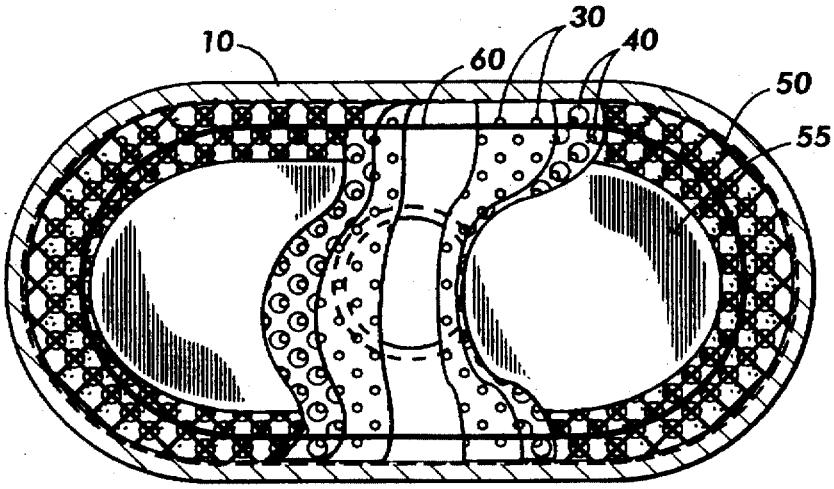
FIG. 7 depicts a top view of a flexible belt after it has been placed inside the fluid reservoir.

Referring again to FIG. 1, coating fluid 80 will pass through flow director 50 after it exits the holes in perforated plate 40. In the preferred embodiment, flow director 50 is a honeycomb member with its center portion cut out as depicted in FIG. 4. The bottom of the cut-out portion of flow director 50 is a flat solid surface 55. The presence of surface 55 will cause coating fluid 80 to be pushed to the outside edges of flow director 50 as the fluid moves through fluid reservoir 10. When fluid reservoir 10 is assembled, the honeycomb portion of flow director 50 will lie at the bottom of the annular space that is formed when flexible belt 60 is placed into the top of fluid reservoir 10. This allows coating fluid 80 to move in a smooth, even manner as it moves past flexible belt 60, thereby depositing an even coating layer onto its outer surface. Some or all of the interior of flexible belt 60 may also be coated with coating fluid 80. It is usually not necessary to ensure that a uniform layer is deposited onto the interior of flexible belt 60 since this surface will not be used during imaging. Once the outside surface of flexible belt 60 has an even coating, the belt can be used as an OPC in an electrophotographic imaging machine.

The remaining discussion will provide the details required to design the various parts of fluid reservoir 10. The major considerations for completing the design are the characteristics of coating fluid 80, such as its density and viscosity, and the flow rate imposed by the accompanying hardware. The available dimensions for fluid reservoir 10 will impose further limitations.

The flow rate Q of a fluid is generally defined as:

$$Q=\frac{nVD^2}{4} \tag{1}$$

where V is the fluid velocity, and D is the diameter of the conduit through which the fluid flows. When the fluid flows through a device such as a flat plate containing holes as in the present case, its flow rate is equal to:

$$Q=\frac{nnVD^2}{4} \tag{2}$$

where n is the number of holes on the plate, and D is the diameter of each hole. (Note, if the holes across the plate do not have the same diameter sizes, each diameter must be squared separately, and the sum of these squared values will replace the term "$D^2$" in equation 2.)

As previously stated, coating fluid 80 must exhibit laminar flow when it exits the holes on the upper surface of perforated plate 40. This means that the Reynolds number of coating fluid 80 must be substantially less than 2000 at that location. Fluid velocity, is defined in terms of Reynolds number, Re, as:

$$V=\frac{Re\mu}{\rho D} \tag{3}$$

where μ is the viscosity of coating fluid 80 and ρ its density. The relationship between velocity $V_{40}$ of coating fluid 80 as it exits the holes of perforated plate 40, and $D_{40}$ the diameter of the holes on perforated plate 40 can be calculated by entering an assumed value for the Reynolds number into equation (3). It will usually be appropriate to assume that the Reynolds number is equal to 1000. Thus:

$$V_{40}D_{40}=\frac{1000\mu}{\rho}$$

Once a value for the Reynolds number is chosen, $V_{40}$ and $D_{40}$ can be adjusted until an appropriate combination of the two values is produced. The maximum available size of fluid reservoir 10 must also be considered. This factor will obviously limit size of the holes in perforated plate 40.

Once the size of the holes in perforated plate 40 is determined, it will be necessary to calculate the required number of holes. That number will be based upon the flow rate Q of coating fluid 80 as it enters the bottom of fluid reservoir 10. Flow rate Q is a pre-determined value, imposed upon fluid reservoir 10 by the hardware used to pump coating fluid 80 into the reservoir. This value will remain constant for the entire time coating fluid 80 rises through fluid reservoir 10. Solving equation (2) for $n_{40}$, the number of holes in perforated plate 40, leaves:

$$n_{40}=\frac{4Q}{nD_{40}^2V_{40}}$$

The shape of the outside edge of perforated plate 40 must be the same as that of the interior wall of fluid reservoir 10 in order for the two parts to be mounted together.

The design of porous membrane 30 is performed in the same manner as that used to design perforated plate 40, except that the assumed value of the Reynolds number should be higher. That is, since the flow is only semi-laminar when the fluid exits the holes in porous membrane 30, the assumed Reynolds number should be 3000, rather than 1000. From equation 3:

$$V_{30}D_{30}=\frac{3000\mu}{\rho}$$

Then:

$$n_{30}=\frac{4Q}{nD_{30}^2V_{30}}$$

The outside edge of porous membrane 30 must also have the same shape as that of the interior wall of fluid reservoir 10 so that it can be mounted to fluid reservoir 10.

After coating fluid 80 has passed through perforated plate 40, the flow will have been reduced to the point that a smooth, even coating can be deposited onto flexible belt 60. Coating fluid 80 will then pass through flow director 50, and force the coating to move toward the wall of fluid reservoir 10, to be deposited onto the outer surface of flexible belt 60. The sizing of the honeycomb used for flow director 50 must be of sufficient size to allow coating fluid 80 to remain in its smooth, steady state without forming eddies as it flows from flow director 50 into the annular space between flexible belt 60 and the wall of fluid reservoir 10. As was true of perforated plate 40 and porous membrane 30, the shape of the outside edge of flow director 50 must be identical to that of the interior wall of fluid reservoir 10 so they can be mounted together.

Although this invention is especially useful for the fabrication of electrophotographic and electrostatic imaging members, it is not limited to such application. The invention has significant advantages over current methods for transforming flexible belts into electrophotographic imaging members. Most notably, it provides a means for dipping a flexible belt in an oval configuration. This allows more belts to be dipped at a single time resulting in significant savings in manufacturing costs.

Use of the flat plates to distribute the flow of coating fluid 80 allows the fluid flow to be reduced from turbulent to laminar, ultimately resulting in low velocity, uniform flow in the annulus between the tank and the belt. This allows the photosensitive coating to be evenly deposited onto the surface of the belt, and enables it to perform as a photoreceptor in an electrophotographic imaging machine. An added advantage of the present invention is that forcing the fluid through a porous membrane prevents flocs and material aglomerations from forming when pigmented coating solutions are used.

The design of the present invention requires a shorter tank than does the hardware that is presently being used for the same purpose. This means that the present invention will reduce the amount of material used to manufacture the fluid reservoir, resulting in additional manufacturing cost savings.

It is, therefore, apparent that there has been provided in accordance with the present invention, a fluid reservoir for dipping and coating oval shaped flexible belts that fully satisfies the aims and advantages herein set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A fluid reservoir for dipping non-cylindrical members in a fluid comprising:

a) a tank;

b) said tank defining an inlet through which the fluid may enter;

c) a flow divider;

d) a porous membrane;

e) a perforated plate; and f) a flow director, whereby movement of the fluid through the reservoir will cause the characteristics of the fluid to be transformed from turbulent, unsteady and non-uniform, to laminar, steady-state, and uniform.

2. The fluid reservoir of claim 1 wherein said flow divider comprises:

a) a three dimensional surface; and b) said surface located in fixed relationship to said inlet, such that the entering fluid is divided into two substantially equal portions as it moves past said flow divider.

3. The fluid reservoir of claim 1 wherein said porous membrane comprises:

a) a first flat plate;

b) said first flat plate located between said inlet and an end of said tank opposite said inlet; and c) said first flat plate having a shape conforming to a horizontal cross-section of said tank such that said first flat plate is abuttable to an interior wall of said tank.

4. The fluid reservoir of claim 3 wherein said porous membrane further comprises:

a) said first flat plate defining a plurality of apertures dispersed throughout a surface of said first flat plate; and b) said apertures having diameters of sufficient size to cause the exiting fluid to have a Reynolds number less than or equal to 3000.

5. The fluid reservoir of claim 1 wherein said porous membrane is mounted to an interior wall of said tank such that an outside edge of said porous membrane is attached to an interior wall of said tank.

6. The fluid reservoir of claim 1 wherein said perforated plate comprises:

a) a second flat plate;

b) said second flat plate located between said porous membrane and said end of said tank opposite said inlet; and c) said second flat plate having a shape conforming to a horizontal cross-section of said tank such that said second flat plate is abuttable to said interior wall of said tank.

7. The fluid reservoir of claim 6 wherein said perforated plate further comprises:

a) said second flat plate defining a plurality of apertures dispersed throughout a surface of said second flat plate; and b) said apertures having diameters of sufficient size to cause the exiting fluid to have a Reynolds number less than 2000.

8. The fluid reservoir of claim 7 wherein said apertures are located around an edge of said surface of said second flat plate, leaving a solid interior surface without apertures.

9. The fluid reservoir of claim 7 wherein said apertures have diameters of sufficient size to cause the exiting fluid to have a Reynolds number between 800 and 1500.

10. The fluid reservoir of claim 1 wherein said perforated plate is mounted to said interior wall of said tank such that an outside edge of said perforated plate is attached to said interior wall of said tank.

11. The fluid reservoir of claim 1 wherein said flow director includes:

a) a panel of intersecting flat surfaces, said intersecting flat surfaces defining a plurality of channels;

b) said panel located between said perforated plate and said end of said tank opposite said inlet; and c) said panel having a shape compatible with a horizontal cross-section of said tank such that said panel is abuttable to said interior wall of said tank.

12. The fluid reservoir of claim 11 wherein said intersecting flat surfaces have sufficient cross-section to allow a fluid with laminar flow characteristics to maintain a constant velocity from the time said fluid enters said channels until said fluid exits said channels.

13. The fluid reservoir of claim 11 wherein said panel is mounted to said interior wall of said tank such that an outside edge of said flow director is attached to said interior wall of said tank.

14. The fluid reservoir of claim 11 wherein said flow director further includes:

a) a center portion of said panel removed to form an annular space; and b) an end of a center portion of said panel filled with a solid substance such that the entering fluid is forced into said annular space.

15. The fluid reservoir of claim 1 wherein the shape of said tank is non-cylindrical.

16. The fluid reservoir of claim 11 wherein said flow director panel is a honeycomb structure.

* * * * *